US007503263B2

(12) United States Patent
Birkigt et al.

(10) Patent No.: US 7,503,263 B2
(45) Date of Patent: Mar. 17, 2009

(54) DEVICE FOR SUSPENDING A RAIL OF AN OVERHEAD CONVEYOR OR A HOISTING MACHINE

(75) Inventors: Reinhard Birkigt, Herdecke (DE); Michael Buike, Hagen (DE); Klaus Enners, Wuppertal (DE); Stefan Fitzler, Iserlohn (DE); Udo Gersemsky, Herdecke (DE); Ingo Grassmann, Herdecke (DE); Sven Müller, Breckerfeld (DE); Klaus Nerger, Neukirchen-Vluyn (DE); Stefan Steinberg, Selm (DE); Rüdiger Ostholt, Wetter (DE)

(73) Assignee: Demag Cranes & Components GmbH, Wetter (DE)

( * ) Notice: Subject to any disclaimer, the term of this patent is extended or adjusted under 35 U.S.C. 154(b) by 217 days.

(21) Appl. No.: 11/537,116

(22) Filed: Sep. 29, 2006

(65) Prior Publication Data

US 2008/0041806 A1 Feb. 21, 2008

(30) Foreign Application Priority Data

Oct. 1, 2005 (DE) ..... 10 2005 047 205

(51) Int. Cl.
*E01B 25/22* (2006.01)
*B66C 19/00* (2006.01)

(52) U.S. Cl. ..... 104/111; 104/93; 212/315

(58) Field of Classification Search ..... 104/111, 104/93; 105/148; 212/315
See application file for complete search history.

(56) References Cited

U.S. PATENT DOCUMENTS 3,095,174 A * 6/1963 Dehn et al. ..... 248/324
3,809,382 A * 5/1974 Pamer ..... 267/64.23
3,949,961 A * 4/1976 Pamer ..... 248/613

(Continued)

FOREIGN PATENT DOCUMENTS

CA 2102585 5/1995

(Continued)

OTHER PUBLICATIONS

International Search Report and Written Opinion from corresponding Patent Cooperation Treaty Application No. PCT/EP06/65073, dated Nov. 30, 2006, which corresponds to U.S. Appl. No. 12/088,366.

(Continued)

*Primary Examiner*—S. Joseph Morano
*Assistant Examiner*—Jason C Smith
(74) *Attorney, Agent, or Firm*—Van Dyke, Gardner, Linn & Burkhart, LLP

(57) ABSTRACT

A device for suspending a rail, such as a travel rail of an overhead conveyor or a hoisting machine, from a traversing gear or supporting structure includes a tension element secured by one end to the rail. A bolt passes through the tension element and is received by a fixing device that is secured to the rail. The tension element is at least partly recessed in the fixing device in the direction of suspension. In order to provide a secure device that has a long service life and a low structural height, the tension element is fastened to the bolt by a ball-shaped joint, such as a pivoting bearing.

26 Claims, 7 Drawing Sheets

U.S. PATENT DOCUMENTS

| | | | | | |
|---|---|---|---|---|---|
| 4,116,134 | A | * | 9/1978 | Troth | 104/111 |
| 4,296,690 | A | * | 10/1981 | Baltensperger et al. | 104/91 |
| 5,357,868 | A | * | 10/1994 | Maas | 105/180 |
| 5,598,785 | A | * | 2/1997 | Zaguroli, Jr. | 104/111 |
| 5,957,057 | A | * | 9/1999 | Nakamura et al. | 104/111 |
| 6,058,849 | A | * | 5/2000 | Ostholt et al. | 104/93 |
| 6,138,574 | A | * | 10/2000 | Zaguroli, Jr. | 104/106 |
| 6,196,133 | B1 | * | 3/2001 | Fitzler et al. | 105/148 |
| 2004/0238473 | A1 | * | 12/2004 | McKay | 212/315 |
| 2008/0041806 | A1 | * | 2/2008 | Birkigt et al. | 212/315 |
| 2008/0230503 | A1 | * | 9/2008 | Birkigt et al. | 212/71 |

FOREIGN PATENT DOCUMENTS

| | | | | |
|---|---|---|---|---|
| DE | A 1 096 288 | | | 12/1960 |
| DE | 197 53 169 | A1 | | 6/1999 |
| DE | 101 15 565 | A1 | | 9/2002 |
| EP | 0 567 295 | A1 | | 10/1993 |
| EP | 0 656 312 | A1 | | 6/1995 |
| EP | 0 860 394 | A2 | | 2/1998 |
| EP | 0 845 435 | A1 | | 6/1998 |
| EP | 860394 | A2 | * | 8/1998 |
| JP | 56 155186 | A | | 12/1981 |
| WO | 03/101878 | A1 | | 12/2003 |

OTHER PUBLICATIONS

Mar. 2000 Prospectus entitled "Crane Construction Kit KBK Classic and KBK Ergo" from Demag Cranes & Components GmbH of Wetter, Germany, the assignee of the present application.

Photograph of suspension system by Ingersoll Rand Zimmerman (dated 2005; exact date unknown).

Commonly assigned co-pending U.S. Appl. No. 12/088,366, filed Apr. 1, 2008, entitled Device for Suspending a Rail, Particularly a Running Rail of an Overhead Conveyor or of a Lifting Apparatus.

* cited by examiner

DEVICE FOR SUSPENDING A RAIL OF AN OVERHEAD CONVEYOR OR A HOISTING MACHINE

The invention pertains to a device for suspending a rail, and particularly to a device for suspending a travel rail of an overhead conveyor or a hoisting machine.

BACKGROUND OF THE INVENTION

From the prospectus (March 2000 edition) entitled "Crane Construction Kit KBK classic and KBK ergo" of the firm Demag Cranes & Components GmbH, Wetter, Germany, there is known a crane construction kit system with C-shaped and I-shaped rails which are open at the bottom, by which one can implement different kinds of constructions, such as monorail telphers and single and double-beam overhead cranes. In each case, the rails are suspended from support structures, other rails, or traversing gears which run into other rails. These suspension systems have a pendulum type design, which ensures that the rails align themselves and thus come into a state of equilibrium, i.e., no significant bending load occurs in the tension element. The pendulum suspension occurs through ball and socket bearings, having steel ball segments and mating ball cups with plastic slide shells. The ball segments are fastened to the end of a compound tension element. Thus, the tension element for the most part consists (looking down from above) of a lug to fasten the tension element to the supporting structures, other rails or traversing gears, and a shaft joined to it as a single piece, on which the ball segment is screwed and secured.

In a suspension system of C-shaped rails open at the bottom, with a web broadening out toward the top and arranged at the top side of the rail, preferably a Y-shaped or T-shaped web, the fixing device consists of two identical fixing parts. These fixing parts are formed as sheet metal parts in such a way that, after being fitted together and held by screws, the broadening web of the rail is clamped in the lower region and the ball cup is accommodated in the upper region, while the tension element is passed through an opening.

This type of suspension system has been popular for many years and is easily installed on any given portion of a rail, since the fixing parts are fitted together there and tightened together by the screws for clamping against the rail.

From US 2004/0238473 A1 there is known a crane arrangement in which a bridge girder can run on parallel rails that are spaced apart from each other by means of traversing gears arranged at its ends. The bridge girder is clamped together with the traversing gears by U-shaped stirrups, open at the bottom, which enclose the bridge girder. Between the stirrups and the traversing gears, there are vertically-oriented ball and socket bearings, so that the traversing gears can turn 360 degrees about a vertical axis relative to the bridge girder and can also be tilted laterally. The ball and socket bearings have balls made of steel and cups of nylon.

In these ball and socket elements, the ball of the tension element must be introduced into the ball cup, while the shaft passes through the central bore of the cup. Therefore, the tension elements are made of at least two parts, namely, a tension rod and a ball head, which are fastened to each other after being assembled with the tension rod introduced through the central bore in the ball cup. One often uses ball nuts that are screwed onto the tension rod. This connection is secured, for example, by a cotter pin.

However, this design of the tension element can only fulfill the load requirements placed on the tension element by an overdimensioning. Furthermore, the parts of the above ball and socket unit have to be appropriately machined or fabricated in order to enable their connection.

In addition, the ball cups can be ruined by improper use or deficient maintenance, which results in increased friction between ball head and ball cup. In the case of two-part tension elements made from a tension rod and ball head, the element securing the connection between tension rod and ball head is then overloaded. This can result in collapse of the bridge girder. The securing element can also fail, which likewise results in a failure of the suspension. Furthermore, the tension rod is weakened by the notch effect of the thread placed on it. Moreover, when the load is removed from the rail, the rail lifts slightly and the ball cup is pulled off from the ball head. When the rail is then placed under load, there is an abrupt loading of the ball and socket joint, which also has to be factored into the design.

Moreover, suspension systems are known from the firm Ingersoll Rand Zimmerman, Milwaukee, USA (see, for example, www.irtools.com/_imgLibrary/complete/Zimmerman_HaengerAjc__1.jpg). The suspension system includes a C-shaped crane rail open at the bottom, having a Y-shaped web broadening at the top, which is arranged on the top side of the rail for a fixing unit made of two identical fixing parts. This suspension system has a tension element consisting essentially of a tension rod and a lug. The tension rod is mounted in the lug by its lower end, able to turn about a vertical axis, and secured rigidly to a supporting structure at its upper end. The lug, in turn, is fastened by its bore to a bolt, extending in the lengthwise direction of the rail. Thus, the tension element can swivel transversely to the rail and can turn about a vertical axis. The tension element is rigid in and against the lengthwise direction of the rail. Furthermore, the bolt for the lug is mounted in the fixing parts. The fixing parts can swivel about the bolt and restrain a Y-shaped web by means of screws. The screws are led through a borehole in the web.

Also known from the firm Krantechnik Müller, Lebach, Germany, are additional suspension systems for the above-described C-shaped crane rails, open at the bottom, with the Y-shaped broadening web. These consist essentially of a tension element, a pivoting bearing, a bolt, a bracket and a fixing device. The tension element has one borehole at each its upper and its lower end, each of which receive a pivoting bearing with a ball cup and a ball head. The ball head is connected to the bolt, which extends in the lengthwise direction of the rail. The ends of the bolt extending in front of and behind the ball head are each secured in pivoting manner and by a cotter pin in the legs of a U-shaped bracket, open at the top, whose web extending below and at a distance from the bolt is accommodated by the fixing device with the Y-shaped web. The fixing device consists of two identical fixing parts, which are fastened by screws to clamp against the web of the bracket and the Y-shaped web of the rail. Use of the bracket results in a large structural height. The pivoting mounting of the ends of the bolt in the legs of the bracket results in wear on the boreholes of the bracket.

European patent application EP 0 860 394 A2 describes the fastening of a tension element with a ball head in a mating ball cup by a fixing device on a Y-shaped web of a rail. The fixing device could be a one-piece device. The ball head of the tension element is led from above through the appropriately dimensioned opening of the fixing device and then the two-piece ball cup will likewise be introduced through this opening from the side. Whether the fixing device is secured by further means to the Y-shaped web of the rail is not specified.

German patent application DE-A 51 096 288 shows a fixing device for suspending a rail from an I-shaped beam.

This C-shaped fixing device, open on top, has two opposite and swiveling gripping arms which, after the fixing device is arranged underneath the web of the rail, are swiveled by their hook-like ends into a fixing position on the top side of the web. The gripping arms are each fixed by a screw in the fixing position. In particular, this type of fixing is distinguished by the possibility of adjusting the fixing system with regard to the I-shaped rail. Even in the fixing position of the gripping arms, there is sufficient lateral play to adjust the screws and move the fixing device itself sideways in relation to the rail. This document does not discuss preventing a collapse caused by failure of the screws.

Moreover, there is known from German patent DE 197 53 169 C2 a device for suspending a rail, especially a hollow rail open at the bottom for an overhead crane. Here, the rail also includes a Y-shaped web arranged on top, being enclosed by a C-shaped fixing device, which is suspended via a ball head and a tension element from an I-shaped rail. The fixing device between the ball head and the Y-shaped web is in two pieces and is joined together by two screws extending transversely to the rail, and arranged one behind the other in the lengthwise direction of the rail. Thus, the ball head is grasped by the two parts of the fixing device. A failure of the screws would result in a loosening of the fixing parts, thus releasing the ball head of the tension element.

Moreover, a device for suspending the rails of a rail system for an overhead crane is known from DE 101 15 565 C2, having elastic damper elements in the region where the ball heads are supported.

SUMMARY OF THE INVENTION

The present invention provides a device for suspending a rail, such as a travel rail of an overhead conveyor or hoisting machine, which is secure, has a long service life, and has a low structural height.

According to the present invention, a device for suspending a rail, such as a travel rail of an overhead conveyor or a hoisting machine, from a traversing gear or supporting structure includes a tension element secured by one end to the rail. A bolt passes through the tension element and is received by a fixing device that is secured to the rail. The tension element is at least partly recessed in the fixing device in the direction of suspension. The tension element is fastened to the bolt by a ball-shaped joint, especially a pivoting bearing, which may achieve a secure construction as well as a long service life and a low structural height.

The bolt may be directly connected to the fixing device to minimize the structural height of the overall suspension and to increase the safety of the suspension. The use of a pivoting bearing may result in long service life. The design is simplified in that commercial, industrially manufactured pivoting bearings may be used, which are relatively low in wear and tear. Furthermore, considerable savings in the construction is achieved because no special parts are needed, as was formerly the case with the known suspension systems.

A "pivoting bearing" refers to a commercially available, ready to use, standardized and industrially manufactured radial pivoting bearing such as those per DIN ISO 12240, which are jointed, and enable three-dimensional adjustments. Pivoting bearings are structural units that have an outer race, in which an inner race is mounted. The inner race has a cylindrical bore to accommodate a bolt without twisting, and a spherical outer slide track to form the ball head. This outer slide track engages with a hollow spherical inner slide track of the outer race, which is inserted by its cylindrical envelope surface in a bore without twisting. Both the outer slide track and the inner slide track can be made of steel and stand directly against each other. In this case, a supply of lubricant is often used. According to an aspect of the present application, one uses pivoting bearings that have a slide layer or a slide ring, such as one of plastic or Teflon, between the inner and outer race. This slide ring is then secured to the outer race, and the inner race slides in the slide ring. In another design, the outer race may be omitted, and its function may be taken over by the tension element. The inner race in this case is inserted transversely into the broadened bore in the tension element and turned through 90 degrees in the bore to take up its working position. The broad portion of the bore and the gap between the inner race and bore is then filled with a plastic which hardens to form the slide ring.

Optionally, the fixing device may include tapered ends in the direction of the ball-shaped joint, so that the tension element tilts in the lengthwise direction of the bolt.

Further, to achieve a low structural height, the bolt may pass through the ball-shaped joint. The structural height is further minimized in that the bolt may be at least partly recessed into the fixing device in the direction of suspension. Optionally, the entire bolt may be completely recessed into the fixing device in the direction of suspension. This configuration facilitates a secure fastening of the bolt in the fixing device.

In order to achieve a recessing of the tension element and the pivoting bearing in the fixing device, the fixing device may have an intermediate space, looking at right angles, i.e., perpendicular, to the direction of suspension and looking at right angles to the bolt, so that the fixing device has a U-shaped form open at the top, and the tension element or the tension element and the bolt protrude into the intermediate space. The bolt may be oriented with its lengthwise dimension parallel to the lengthwise direction of the rail.

A secure connection of the bolt in the fixing device, and thus a direct flow of force, may be achieved in that the bolt may be held free of torsion in bores in the fixing device by its ends protruding at either side beyond the pivoting bearing. In this configuration, only the pivoting bearing is under stress due to the movements of the suspension system.

In one embodiment, the fixing device may have two fixing parts, between which the ends of the bolt and the rail being supported are clamped by means of screws.

Optionally, to facilitate the fabrication of the fixing device, the fixing parts may be identical.

Optionally, the fixing device may be a one-piece design.

In an alternative embodiment, the fixing device may have a frame-like fixing part, which may be fastened in a T-shaped groove of the rail being supported.

Additional features, details, and benefits of the invention will emerge from the subsidiary claims and the following description of sample embodiments by means of the drawing.

DESCRIPTION OF THE PREFERRED EMBODIMENTS

Figure 1:
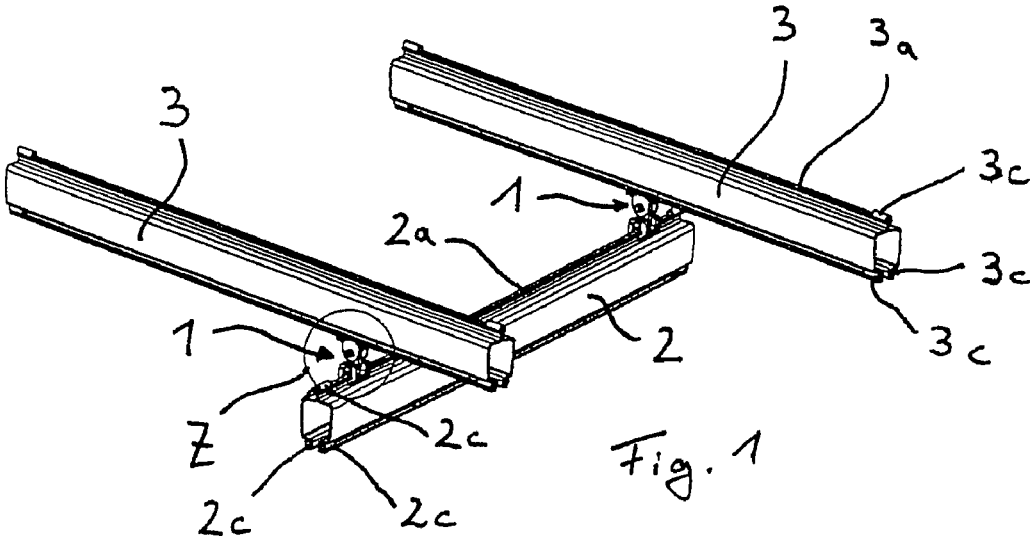
FIG. 1 is a perspective view of a single-beam overhead crane.
Figure 2:
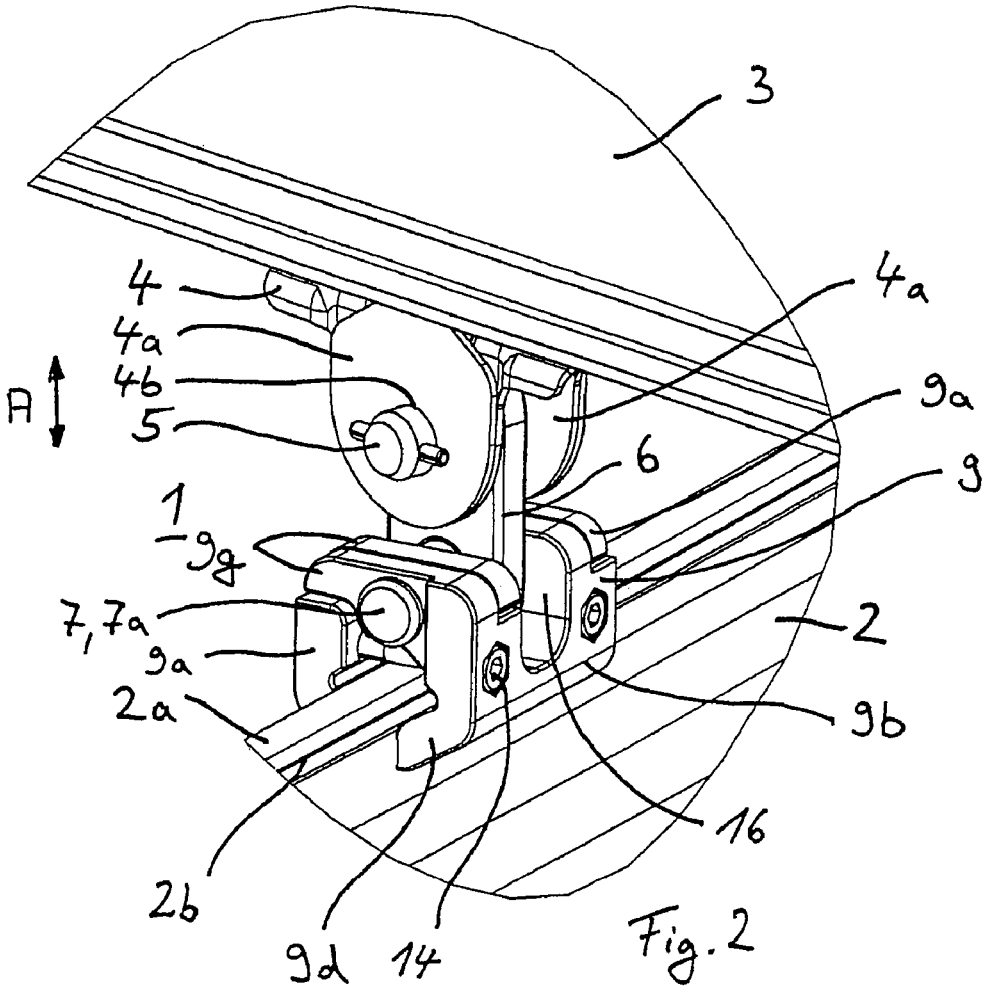
FIG. 2 is a magnified feature of region Z of FIG. 1.

In FIGS. 1 and 2, a single-beam overhead crane 1 is shown with two suspensions, by which an essentially horizontal C-shaped rail 2, open at the bottom, is suspended from two essentially horizontal C-shaped travel rails 3, likewise open at the bottom, which are laid in parallel and at a distance from each other. The rail 2 travels essentially transverse to the travel rails 3 and can move along the travel rails 3. The rail 2 is suspended from a traversing gear 4 by the two suspensions 1 (see FIG. 2), which can travel in the travel rail 3 along its lengthwise direction by means of rollers (not shown). A hoisting machine (not shown), such as a chain or rope block, is hung from the rail 2 and can move with an additional traversing gear along the rail 2. Additional suspensions 1 (not shown) may be included along the travel rails 3, by which these may be suspended from supporting structures, other rails, or traversing gears.

Suspensions 1 have pivoting bearings and thus have a pendulum-type design, which ensures that the rail 2 and the travel rails 3 automatically orient themselves and thus come into a state of equilibrium, i.e., there is no significant bending load in suspension 1 or, in particular, in the tension element 6 arranged in the suspension (see FIG. 2).

Thus, it is possible to grab the hoisting machine at the load or a suspended switch and move it along the rail 2 and the travel rail 3 without a special drive unit. Because of the flow of force off center—and depending on the particular position of the hoisting machine on rail 2—rail 2, with the hoisting machine, may become slanted relative to a position perpendicular to travel rails 3. This slanted position is around 20 to 30 degrees. Normally, such a slanting would result in a seizing of rail 2 or traversing gears 4 on the travel rail 3. But since, as previously mentioned, the suspensions 1 are of a pendulum kind, when travel rails 3 become crooked, they can simply reduce their mutual spacing and traversing gears 4 can continue to travel unhindered in the travel rails 3. By pendulum suspension 1 is meant here that they enable a turning about a vertical axis and also a lateral tilting.

FIG. 2 shows a magnified feature of FIG. 1 from region Z, concerning suspension 1. From this FIG. 2 one clearly sees that the traversing gear 4 has two brackets 4*a*, each with a bore 4*b*. Brackets 4*a*, parallel to each other and spaced apart, extend downward from travel rail 3. An upper end of a tension element 6 of the suspension 1 is arranged between brackets 4*a*. The tension element 6 is fashioned as a flat bracket in the manner of a connecting rod or a strip shape and is oriented roughly perpendicular to the lengthwise axis of rail 2. Tension element 6 has an upper bore 10 and a lower bore 11 (see FIGS. 3, 8, and 10). Tension element 6 is suspended from the traversing gear by a bolt 5, which is passed through the bore 4*b* of the first bracket 4*a*, the upper bore 10 and the bore 4*b* of the second bracket 4*a*. Upper bore 10 has a knife-edge bearing, i.e., bore 10 is crowned in configuration, and bolt 5 is guided point-like on the knife edge formed by the convexity with angular mobility. Lower bore 11 serves to suspend rail 2 from tension element 6. A pivoting bearing 8 is installed in the lower bore 11 (see FIGS. 3, 7 and 10). Bolt 7 is passed through bore 8*c*. The ends 7*a*, 7*b* of bolt 7 project beyond tension element 6 and pivoting bearing 8 in the lengthwise direction of rail 2. Ends 7*a*, 7*b* engage fixing device 9 and are secure in bores 13 without torsion. Fixing device 9 also encloses with form fitting an upper web 2*a* of the rail 2, which is Y-shaped and correspondingly broadens toward the top, starting from the top side of the rail 2. A T-shaped or a different broadening configuration of web 2*a* is also possible.

As an alternative, a pivoting bearing 8 can also be arranged in upper bore 10.

Figure 3:
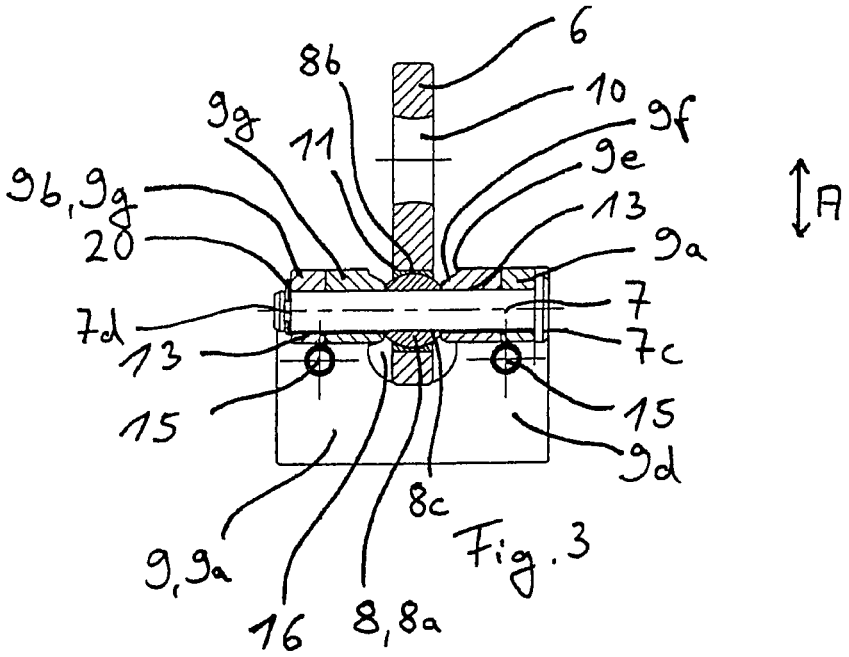
FIG. 3 is a front elevation of the suspension of FIG. 2.
Figure 4:
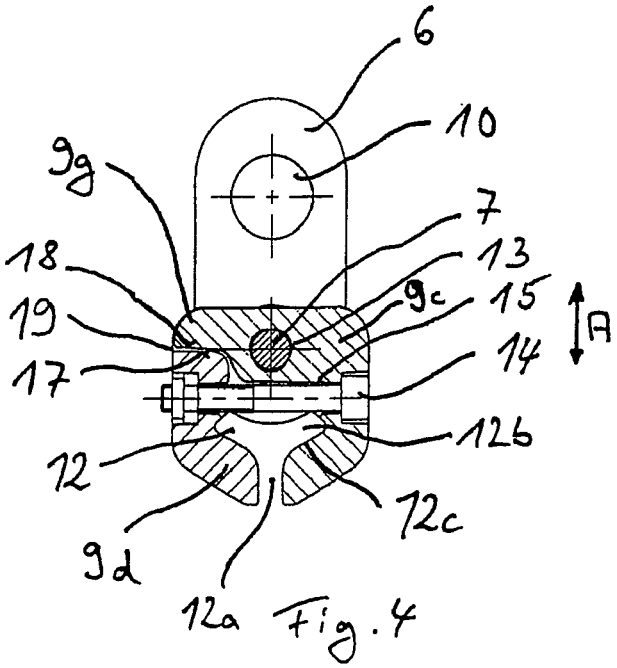
FIG. 4 is a side elevation of FIG. 3, partly sectional, with fixing parts in the fixing position.
Figure 5:
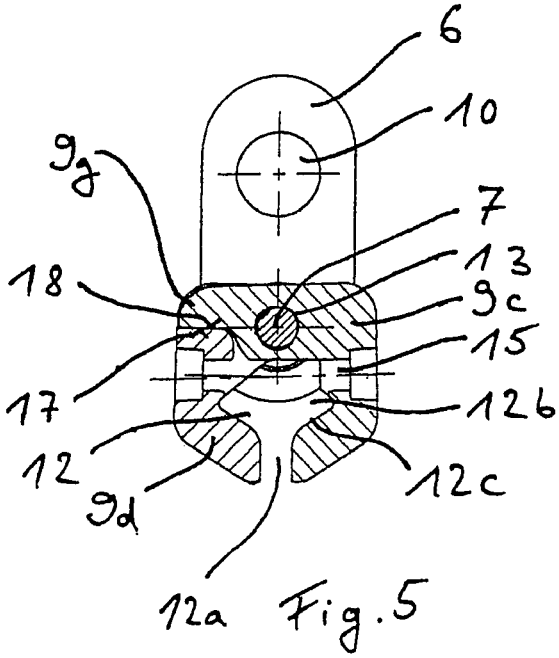
FIG. 5 is the side elevation per FIG. 4 with fixing parts in the open position.
Figure 7:
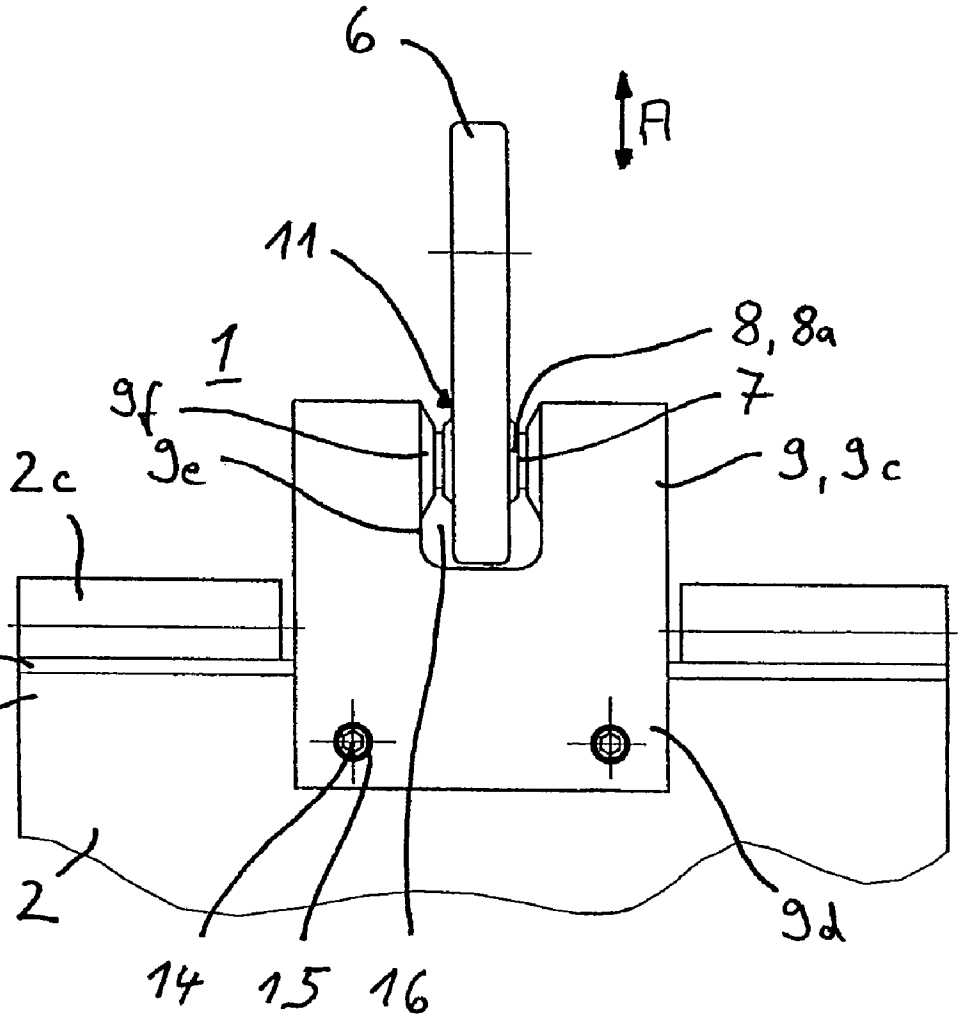
FIG. 7 is a side elevation of FIG. 6.
Figure 6:
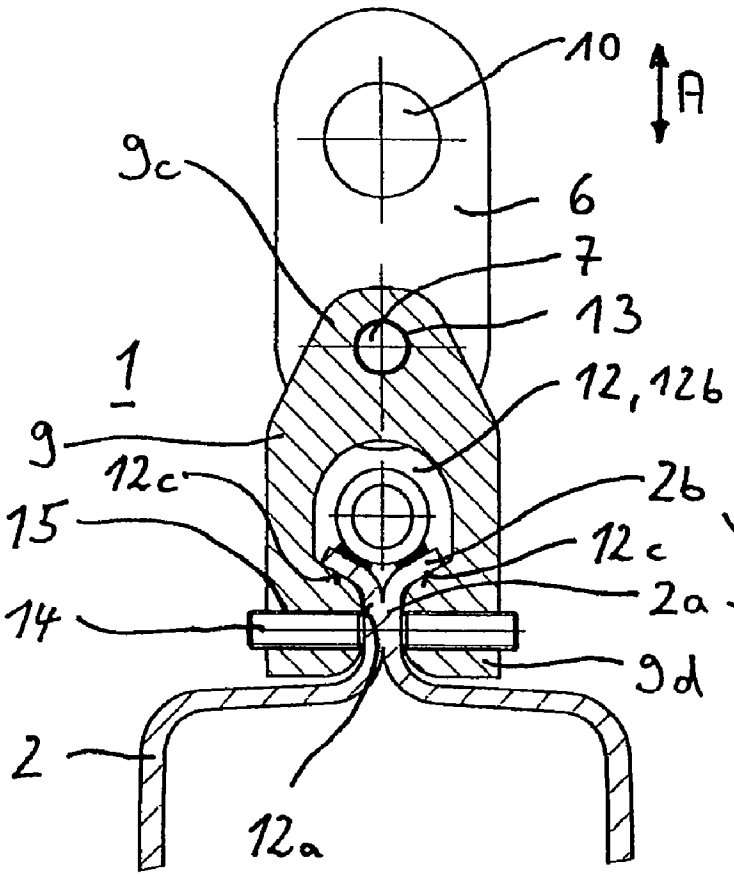
FIG. 6 is a front elevation of a rail segment with a suspension in a first alternative embodiment, partly sectional.
Figure 8:
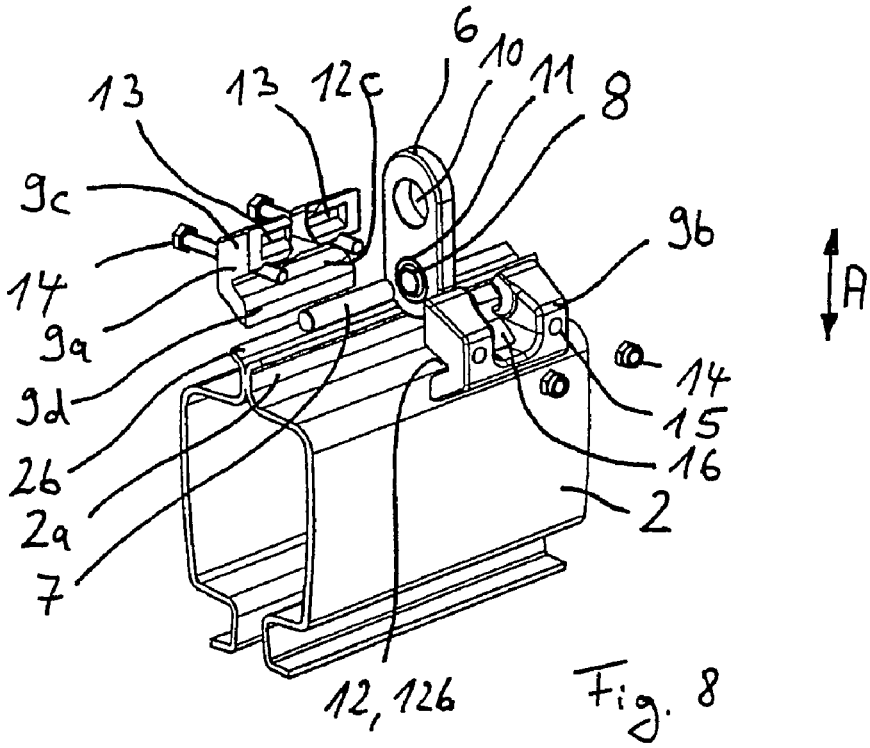
FIG. 8 is a perspective view of a rail segment with a suspension in a second alternative embodiment.
Figure 9:
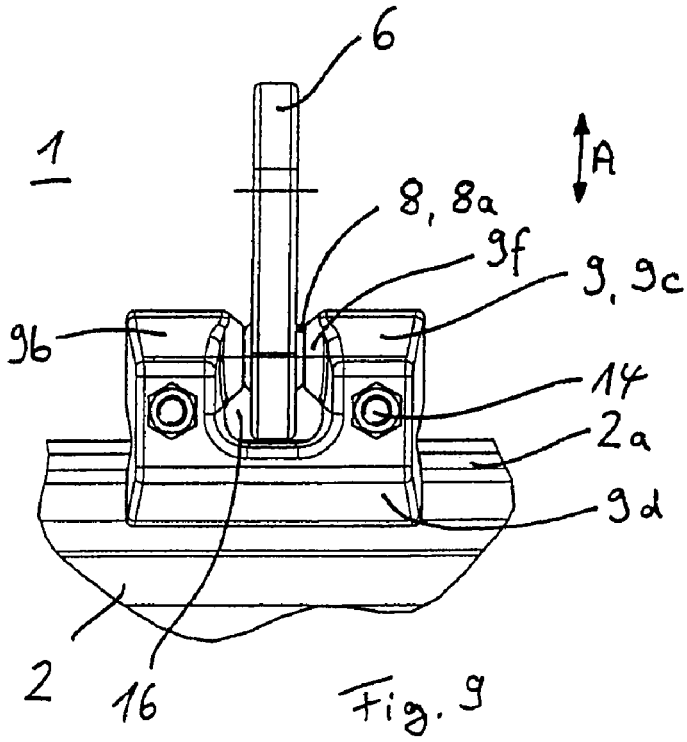
FIG. 9 is a side elevation of FIG. 8.
Figure 10:
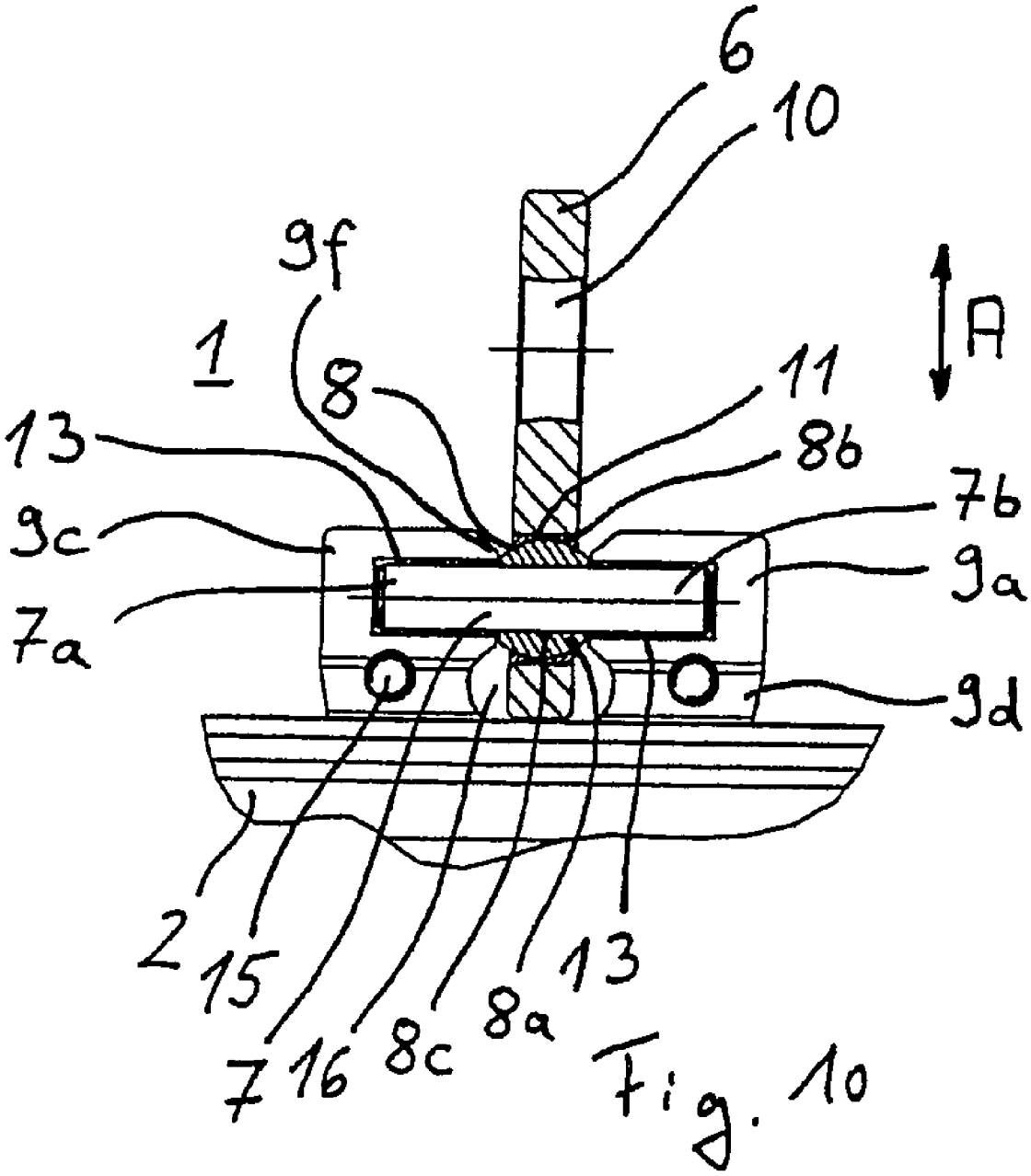
FIG. 10 is a sectional view of FIG. 9.

Suspension 1 for the rail is shown in detail, including fixing device 9, in FIGS. 3-5 in a first embodiment, in FIGS. 6 and 7 in a second embodiment, and in FIGS. 8-10 in a third embodiment. Supplementing the description given for FIG. 2, a pivoting bearing 8 is arranged in the lower bore 11 of the tension element 6, through which the bolt 7 passes. The pivoting bearing 8 is a customary, off the shelf, standardized and industrially manufactured radial pivoting bearing, for example, one per DIN ISO 12240, having an outer race 8*b*, in which an inner race 8*a* is mounted. The inner race 8*a* has a cylindrical bore 8*c* for receiving bolt 7 without twisting and a spherical outer slide track to form the ball head. This outer slide track engages with a hollow inner slide track of the outer race 8*b*, which is installed by its cylindrical envelope surface in the bore 11 free of twisting. Between inner race 8*a* and outer race 8*b* is arranged a slide ring (not shown), for example, made of plastic or Teflon. This slide ring is then fastened to outer race 8*b*, and inner race 8*a* slides in the slide ring. Bolt 7 is oriented parallel to the lengthwise direction of the rail 2. Thus, tension element 6 can swivel sideways to the right and left about bolt 7, relative to fixing device 9 in the lengthwise direction of rail 2, and it can also turn ±15° in the lengthwise direction of tension element 6. An additional ±15° swiveling capability occurs between tension element 6 and bolt 5 at the knife-edge bearing in the bore 10.

In the event that inner race 8*a* and outer race 8*b* are made of steel and are in direct contact, a supply of lubricant is typically provided. In a different design, outer ring 8*b* may be omitted as a separate part, and its function may be taken over by tension element 6. Inner race 8*a* is introduced transversely into widened bore 11 in tension element 6 and turned 90 degrees in bore 11 into a working position. The widening of the bore 11 and the gap between inner race 8*a* and bore 11 are then filled with a plastic which hardens to form the slide ring.

FIGS. 3-5 show a first embodiment of fixing device 9, which comprises two identical fixing parts 9*a* and 9*b*. The two fixing parts 9*a* and 9*b* are fastened together and can swivel, and are limited by bolt 7 for suspension from tension element 6, from an open position to a fixing position. FIG. 4 shows the fixing position, and FIG. 5 shows the open position. In both positions, and any intermediate positions, the fixing parts 9*a*, 9*b* have a C-shaped cross section open at the bottom, which bounds an upwardly broadening, mushroom-shaped lengthwise opening 12 in the lengthwise direction of rail 2. In terms of function, fixing parts 9*a*, 9*b* may be divided into an upper suspension region 9*c* and a lower fixing region 9*d*. Lengthwise opening 12, which is bounded by fixing region 9*d* of fixing parts 9*a*, 9*b*, has a lower gap region 12*a* and, above it, an opening region 12*b*. Thus, in the lengthwise direction of rail 2, fixing region 9*d* has the shape of two opposite fixing arms or gripping arms, spaced apart and bent inward at the lower free end. The gripping arms are bent toward each other, terminating in the gap region 12*a*, thus diminishing the opening region 12*b*. In opening region 12*b*, fixing region 9*d* has flat bearing surfaces 12*c*, slanting upward and starting from gap region 12*a*. Bearing surfaces 12*c* allow for a two-dimensional accommodation of ends 2*b* of Y-shaped web 2*a*, broadening outwardly in opposite directions. Thus, bearing surfaces 12*c* take the load of rail 2 and the load suspended from or being carried thereon, regardless of whether fixing device 9 is in the open or fixing position.

Fixing parts 9*a*, 9*b* have limited angular mobility around the bolt 7 and form a type of pincer mechanism to restrain rail 2. However, the special feature of fixing parts 9*a*, 9*b* is that their angular mobility is limited such that, even in the open position, the ends 2*b* of web 2*a* cannot slip down or out of the lengthwise opening 12 of fixing device 9. Thus, ends 2*b* of web 2*a* are firmly restrained.

In the first embodiment, fixing device 9 of suspension 1, including its fixing parts 9*a* and 9*b*, has an intermediate space 16, which is open at the top. Intermediate space 16 runs transversely and horizontally in the lengthwise direction of rail 2 and is bounded by a U-shaped fixing device 9, especially its web-like suspension regions 9*c*. On the inner sides 9*e* of suspension regions 9*c* of fixing device 9, which face each other, there are arranged flat conical projections 9*f*. Bores 13 of suspension regions 9*c* of fixing device 9 for bolt 7 are continued centrally in projections 9*f*. Because of projections 9*f*, intermediate space 16 is narrowed, and resting surfaces are created for pivoting bearing 8.

Moreover, intermediate space 16 divides the pivoting connection of the two fixing parts 9*a*, 9*b* into a first and a second hinge-like pivot region. Each of these pivot regions has an arm 9*g* of fixing region 9*d* of the particular fixing part 9*a*, 9*b*. Each of the arms 9*g* receives a portion of bore 13 for bolt 7, generally down the center in the lengthwise direction of the rail 2. The arrangement of arms 9*g*, bolt 7 and bore 13 is comparable to a multiple-section bolt connection.

In order to accomplish the aforementioned limiting of the angular mobility of fixing parts 9*a* and 9*b*, bearing surfaces 17 are formed on the one fixing part 9*a* and mating surfaces 18 on the other fixing part 9*b*. Mating surfaces 18 are arranged on the lower sides of the free ends of the arms 9*g* and are oriented generally horizontally. Bearing surfaces 17 are situated at the side next to the beginning of the arm 9*g* on the fixing part 9*a*, 9*b*, which is opposite the free end, and thus they lie opposite each other in relation to the bolt 7.

In the open position of fixing parts 9*a* and 9*b*, bearing surfaces 17 and mating surfaces 18 come to bear against each other. Mating surfaces 18 and bearing surfaces 17 are arranged like the clamping jaws of pliers in relation to each other. In the fixing position, bearing surfaces 17 are separated from mating surfaces 18 by a gap 19. However, bearing surfaces 17 and mating surfaces 18 do not prevent a closing movement, i.e., a bearing against webs 2*a*, in the manner of pliers between the gripping levers.

To be able to secure the fixing device 9 at a desired position in the lengthwise direction after it is shoved onto the web 2*a* or put together around the web 2*a*, two screws 14 are provided. The screws 14 pass through the fixing parts 9*a*, 9*b* at such a height that they do not interfere with web 2*a* and they cross through the opening region 12*b* of the lengthwise opening 12 beneath the arms 9*g*. By means of the screws 14, the fixing parts 9*a*, 9*b* can be moved about the bolt 7 and swiveled from the open position to the fixing position against each other, until the ends of the gripping arm regions 9*d* come to bear against the web 2*a*. It should be stressed that this clamping mainly functions to secure the fixing device 9 in the lengthwise direction of the rail 2 and has basically no fixing or supporting function.

Accordingly, the size, especially the height of the opening region 12*b* of the lengthwise opening 12, is chosen so that screws 14 have sufficient room to cross the lengthwise opening 12 beneath the bolt 7 and above the web 2*a*. However, the height of the lengthwise opening 12 is not sufficient to shove the fixing device 9 in the assembled condition from one end of the rail 2 onto web 2*a* in the lengthwise direction of rail 2, which runs essentially horizontally. Such a movement is prevented because cylindrical connection sleeves 2*c* are arranged on the web 2*a* in the upper opening of the web 2*a* at the start and end of the rail 2. Connection sleeves 2*c* serve to join the ends of two rails 2 in abutting fashion. Additional connection sleeves 2*c* are located at the C-shaped lower ends of the rail 2 (see FIG. 1). Connection sleeves 2*c*, which lie opposite each other at the end of two rails 2, can then easily be joined by screws and at the same time they will align the rails 2 with each other.

Thus, fixing device 9 must be assembled at the desired suspension point on the rail 2. The two fixing parts 9*a*, 9*b* are joined together without bolt 7 and screws 14 at the desired suspension point on the rail 2 so that the bores 13 are aligned and the web 2*a* of rail 2 is grasped by the fixing regions 9*d* of fixing device 9. Then, bolt 7 is inserted into bore 13 in the lengthwise direction of rail 2 from one side, so that it passes through the part of the bore 13 of the first two arms 9*g* of the fixing parts 9*a*, 9*b*. The tension element 6 with its pivoting bearing 8 is then inserted into the intermediate space 16 and lined up with the bore 13. The bolt 7 is shoved further through the pivoting bearing 8 and the remainder of the bore 13 into the two second arms 9*g* of the fixing parts 9*a*, 9*b* until the head 7*c* of the bolt 7 comes to rest against the fixing device 9. At the other side, the other end 7*a* of the bolt 7 protrudes from the bore 13. To secure the bolt 7 in the bore 13, a circumferential groove 7*d* is provided at the end 7*a* of the bolt 7 sticking out, into which a snap ring 20 is inserted from the side, coming to bear against the other end of the fixing device 9.

Since travel rails 3 have a cross section identical to the rail 2, the above-described web 3*a* and the three connection sleeves 3*c* are included at the ends of the travel rails 3 (see FIG. 1).

In an alternative embodiment of the fixing device 9, not drawn, the height of the opening region 12*b* and the size of the gap region 12*a* of the lengthwise opening 12 in the open position or the spacing of the arm-like fixing regions 9*d* of the fixing device 9 are chosen such that the fixing device 9 can be shoved onto the web 2*a* of the rail 2 from one end in the lengthwise direction of the rail 2, which runs essentially horizontally. The lengthwise opening 12, especially its opening region 12*b*, starting from the gap region 12*a*, is then provided with a sufficient height to allow the web 2*a* as well as the connection sleeves 2*c* to pass.

FIGS. 6 and 7 show a first alternative embodiment of the fixing device 9. As compared to the fixing device 9 previously described, this one is a single-piece design, i.e., only one part 9*a* is present, nor is there a limited swiveling capacity of the parts 9*a* and 9*b* relative to each other. In the lengthwise direction of rail 2, again there is a C-shaped cross section, open at the bottom, bounding a mushroom-shaped and upward broadening lengthwise opening 12 extending in the lengthwise direction of the rail 2. In terms of function, the part 9*a* can be divided into an upper suspension region 9*c* and a lower fixing region 9*d*. The lengthwise opening 12, which is bounded by the fixing region 9*d* of the part 9*a* of the fixing device 9, has a lower gap region 12*a* and, adjoining this at the top, an opening region 12*b*. The fixing region 9*d* thus has the shape, looking in the lengthwise direction of the rail 2, of two fixing arms or gripping arms facing each other, separated by the lengthwise opening 12 and bent inward at their free ends. The gripping arms are bent toward each other and terminate in the gap region 12*a*, and thus narrow the opening region 12*b*.

In the opening region 12*b*, the fixing region 9*d* has flat, upwardly slanting bearing surfaces 12*c*, starting from the gap region 12*a*. These bearing surfaces 12*c* provide a two-dimensional seat for the ends 2*b* of the Y-shaped web 2*a*, which move away from each other in the upward direction. Thus, these bearing surfaces 12*c* absorb the load of both rail 2 and the load being conveyed or suspended from rail 2.

The size of the lengthwise opening 12 or the spacing between the arm-like fixing regions 9*d* of the fixing device 9 is chosen such that the fixing device 9 runs essentially horizontally in the lengthwise direction of rail 2, and can be shoved onto the web 2*a* of rail 2 from one end. The design of the fixing device 9 with the fixing regions 9*d* enclosing the web 2*a* in C-shaped manner ensures that the web 2*a* of a horizontally oriented rail 2 cannot slip downward in the vertical direction from the fixing device 9 and thus the rail 2 is held firmly. Furthermore, the size of the lengthwise opening 12, especially its opening region 12*b*, starting from the gap region 12*a*, has sufficient height to allow both the web 2*a* and the cylindrical connection sleeves 2*c*, arranged in the upper opening of the web 2*a* at the start and end of the rail 2, to pass.

In order to secure the fixing device 9 in a desired position after shoving it onto the web 2*a* in the lengthwise direction of the rail 2, there are four screws 14. Screws 14 are configured as grub screws, being screwed into bores 15, configured as threaded bores. Screws 14 run essentially horizontally and transversely to the lengthwise direction of rail 2, and bear with their tip against or being lightly screwed into the narrow segment of the web 2*a*, i.e., the region of the gap region 12*a* of the lengthwise opening 12. Again, it should be stressed that these screws 14 basically serve only to secure the fixing device 9 in the lengthwise direction of the rail 2 and do not take on any support function.

The fixing device 9 of the first alternative suspension 1 also has an intermediate space 16 open at the top, transversely and horizontally to the lengthwise direction of the rail, being bounded by a U-shaped fixing device 9, including its web-like suspension regions 9*c*. On the inner sides 9*e* of the suspension regions 9*c*, which face each other, flat conical projections 9*f* are arranged. The bores 13 of the suspension regions 9*c* for the bolt 7 are continued centrally in these projections 9*f*. Because of the projections 9*f*, the intermediate space 16 is narrowed and resting surfaces are created for the pivoting bearing 8.

With regard to the configuration of the pivoting bearing 8, refer to the description for FIG. 3-5.

FIGS. 8-10 show a second alternative embodiment of the fixing device 9. Compared to the previously described fixing devices 9, this embodiment includes two identical fixing parts 9*a*, 9*b*, which are joined by screws 14 to clamp against the rail 2. When the fixing parts 9*a*, 9*b* are tightened together by screws 14, again there is a C-shaped cross section open at the bottom, in the lengthwise direction of the rail 2, bounding a mushroom-shaped and upward-broadening lengthwise opening 12 extending in the lengthwise direction of the rail 2. In terms of function, the part 9*a* can be divided into an upper suspension region 9*c* and a lower fixing region 9*d*. This lengthwise opening 12, which is bounded by the fixing region 9*d* of the part 9*a* of the fixing device 9, has a lower gap region 12*a* and, adjoining this at the top, an opening region 12*b*. Thus, in the lengthwise direction of rail 2, the fixing region 9*d* has the shape of two fixing arms or gripping arms facing each other, separated by the lengthwise opening 12 and bent inward at their free lower ends. The gripping arms are bent toward each other, terminating in the gap region 12*a* and thus narrowing the opening region 12*b*. In opening region 12*b*, the fixing region 9*d* has flat, upwardly slanting bearing surfaces 12*c*, starting from the gap region 12*a*. Bearing surfaces 12*c* provide a two-dimensional seat for the ends 2*b* of the Y-shaped web 2*a*, which move away from each other in the upward direction. Thus, these bearing surfaces 12*c* absorb the load of both rail 2 and the load being conveyed or suspended from rail 2.

The height of the opening region 12*b* of the lengthwise opening 12 is chosen so that the screws 14 have sufficient room to cross the lengthwise opening 12 beneath the bolt 7 and above the web 2*a*. However, the height of the lengthwise opening 12 is not sufficient to shove the fixing device 9 in the assembled condition from one end of rail 2 onto web 2*a* in the lengthwise direction of the rail 2, which runs essentially horizontally. Such a movement is prevented because cylindrical connection sleeves 2*c* are arranged on the web 2*a* in the upper opening of the web 2*a* at the start and end of rail 2. Connection sleeves 2*c* serve to join the ends of two rails 2 in abutting fashion. Additional connection sleeves 2*c* are located at the C-shaped lower ends of the rail 2 (see FIG. 1). These connection sleeves 2*c*, which lie opposite each other at the end of two rails 2, can then easily be joined by screws and align the rails 2 with each other.

Thus, the fixing device 9 must be assembled at the desired suspension point on rail 2. The two fixing parts 9*a*, 9*b* are joined together at the desired suspension point on rail 2 so that bores 13, which are configured here as blind holes, enclose the bolt 7. The web 2*a* of rail 2 is grasped by fixing regions 9*d* of the fixing device 9. The fixing parts 9*a*, 9*b* are then joined together by screws 14. Because of the screws 14, bolt 7 is held clamped and unable to twist in bores 13 of fixing parts 9*a*, 9*b*. Screws 14 also press the fixing regions 9*d* of fixing parts 9*a*, 9*b* sideways against web 2*a* of rail 2, so that the fixing device 9 is secured in a desired position in the lengthwise direction of rail 2.

Fixing device 9 of the second alternative suspension 1 also has an intermediate space 16 open at the top, transverse and horizontal to the lengthwise direction of the rail and bound by a U-shaped fixing device 9, including its web-like suspension regions 9*c*. On the inner sides 9*e* of suspension regions 9*c* of the fixing device 9, which face each other, flat conical projections 9*f* are arranged. Bores 13 of the suspension regions 9*c* of the fixing device 9 for the bolt 7 are continued centrally through these projections 9*f*. Because of the projections 9*f*, the intermediate space 16 is narrowed and resting surfaces are created for the pivoting bearing 8, including its inner ring.

With regard to the configuration of the pivoting bearing 8, refer to the description for FIGS. 3 to 5.

Figure 11:
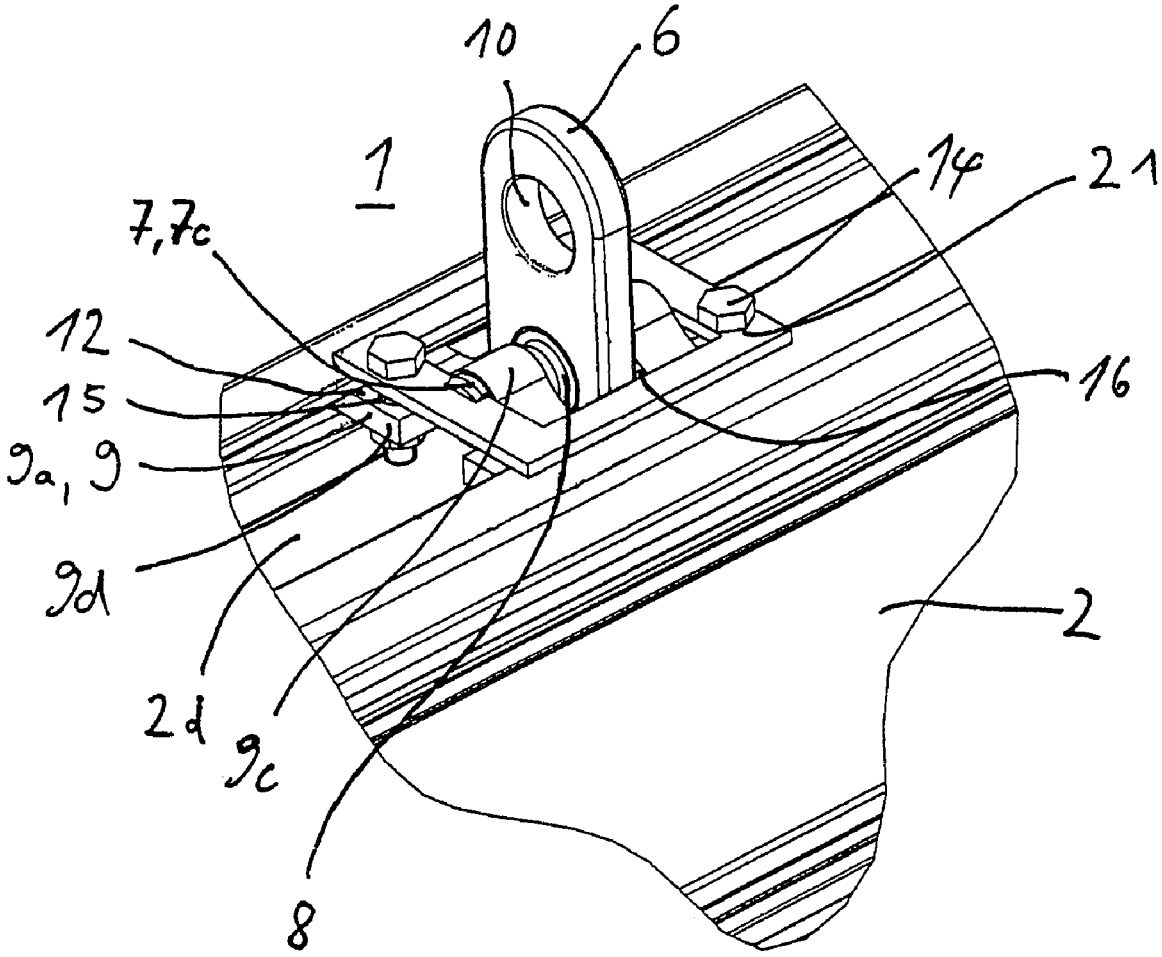
FIG. 11 is a perspective view of a rail segment with a suspension in a third alternative embodiment.
Figure 12:
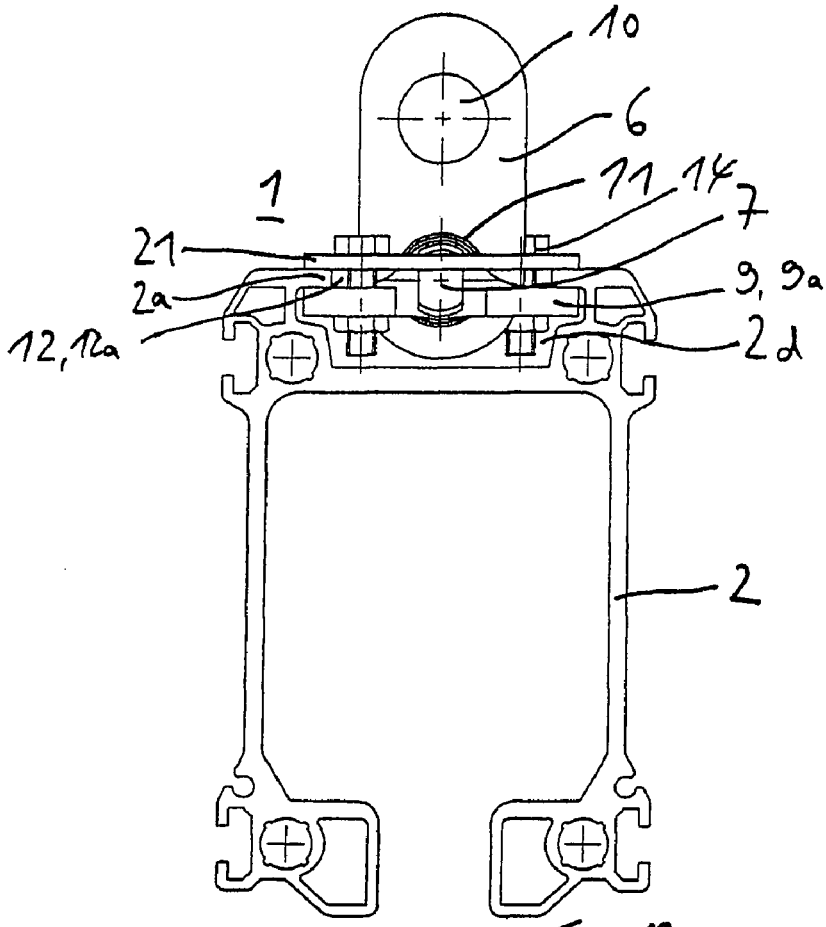
FIG. 12 is a front elevation of FIG. 11.
Figure 13:
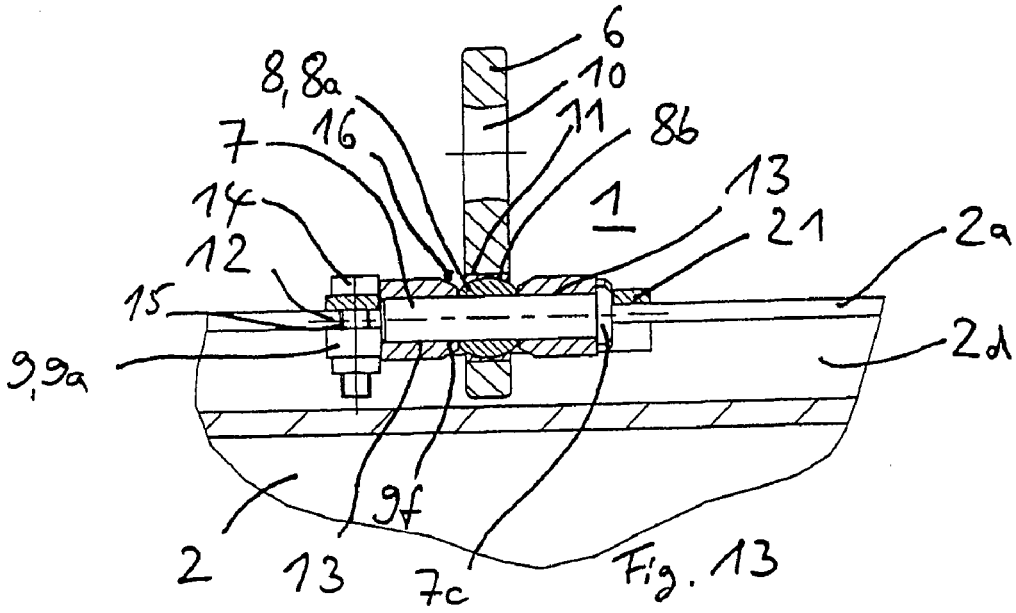
FIG. 13 is a sectional side elevation of FIG. 12.

FIGS. 11 to 13 show a third alternative embodiment of the fixing device 9. As compared to the previously described fixing devices 9, this embodiment is suitable for a different type of rail, such as a C-shaped rail 2 open at the bottom, which may be made of aluminum. This rail 2 has a T-shaped groove 2*d* at the upper side of rail 2, which narrows toward fixing device 9, as opposed to having the ends 2*b* of the Y-shaped web 2*a* moving away from each other. Accordingly, this fixing device 9 is adapted to this type of rail 2.

Fixing device 9 consists of a frame-like fixing part 9*a*, which is shoved into the T-shaped groove 2*d* from one end. Alternatively, when configured in the manner of a tenon block, fixing part 9*a* is inserted from above into the T-shaped groove 2*d* and then turned through 90 degrees, so that the fixing part 9*a* engages beneath the upper webs 2*a* of the groove 2*d*. To secure the fixing part 9*a* at a desired position in the lengthwise direction of rail 2, fixing part 9*a* is pulled upward by screws 14, and thus thrusts against the bottom of the web 2*a* of the T-shaped groove 2*d*. The screws 14 thrust against the top of the web 2*a* of the T-shaped groove 2*d*. Thus, fixing device 9 is clamped firmly on the web 2*a*. If screws 14 should fail, the fixing part 9*a* remains fixed in the T-shaped groove 2*d*. To more safely transfer the clamping forces of screws 14 to the top of the web 2*a* of the T-shaped groove 2*d* or the top of the rail 2*a*, a rectangular frame-like abutment 21 is provided, being arranged above the bores 15 in fixing part 9*a* for screws 14. Abutment 21 extends across the top of web 2*a* of the T-shaped groove 2*d* and the top of rail 2*a*. Two screws 14 engage with the fixing part 9*a* at diagonally opposite corners. To receive the bores 15 for screws 14, the frame-like fixing part 9*a* is extended by a bracket region for each one. Also, a lengthwise opening 12 running in the lengthwise direction of rail 2, with a gap region 12*a*, serving to receive the web 2*a* of the rail 2, is enclosed between the abutment 21 and the first fixing part 9*a* by their margin regions.

This fixing device 9 may also be divided into the previously described fixing region 9*d* and the adjoining suspension region 9*c*. The suspension region 9*c* includes two bores 13 to receive bolt 7. Bores 13 are separated by an intermediate space 16, in which the pivoting bearing 8 and the tension element 6 are recessed. The intermediate space 16 also has projections 9*f* protruding into it, to center the pivoting bearing. Bolt 7 extends through the two bores 13, and the pivoting bearing 8 has a head 7*c* at one end, which is held such that it is unable to twist by a recess in the abutment 21, and held in the bore 13. In the region of bores 13, the otherwise flat fixing part 9*a* is thickened vertically in the manner of pillow blocks. These pillow blocks extend upward from the T-shaped groove 2*d*.

With regard to the configuration of the pivoting bearing 8, refer to the description for FIGS. 3 to 5.

Also, the aforementioned sample embodiment describes the use of the suspension 1 with single-beam overhead cranes, namely, between the rail 2 and the travel rail 3. This new suspension 1, of course, is also suitable for suspending the travel rails 3 from suitable support structures or other rails 2. The rail 2 may also be I-shaped.

Changes and modifications in the specifically described embodiments can be carried out without departing from the principles of the invention which is intended to be limited only by the scope of the appended claims, as interpreted according to the principles of patent law including the doctrine of equivalents.

The embodiments of the invention in which an exclusive property or privilege is claimed are defined as follows:

1. A device for suspending a rail of one of an overhead conveyor and a hoisting machine from one of a traversing gear and a supporting structure, said device comprising:

a tension element, said tension element being secured by one end to the one of a traversing gear and a supporting structure, said tension element being further secured to a fixing device that is secured to the rail;

a bolt, the bolt passing through the tension element and being received by the fixing device, wherein the tension element is at least partly recessed in the fixing device in a direction of suspension;

a pivoting bearing comprising an outer race and an inner race, said inner race comprising a ball head, said ball head pivotably received in said outer race;

a bore defined through said ball head; and wherein the tension element is fastened to the bolt by the pivoting bearing being received in the tension element and the bolt passing through said bore in the ball head.

2. The device per claim 1, wherein at least one end of the fixing device tapers in the direction of the pivoting bearing, wherein the tension element is able to tilt in the lengthwise direction of the bolt.

3. The device per claim 2, wherein the bolt and the tension element are at least partly recessed into the fixing device in the direction of suspension.

4. The device per claim 3, wherein the bolt is completely recessed into the fixing device in the direction of suspension.

5. The device per claim 4, wherein the fixing device has an intermediate space perpendicular to the direction of suspension and perpendicular to the bolt, said fixing device having a U-shaped form open at the top, wherein one of the tension element and the tension element and the bolt protrude into the intermediate space, the bolt being oriented with its lengthwise dimension parallel to the lengthwise direction of the rail.

6. The device per claim 5, wherein the bolt is held free of torsion in bores in the fixing device, wherein ends of the bolt protrude beyond the pivoting bearing.

7. The device per claim 6, wherein the fixing device has two fixing parts, wherein said ends of the bolt and the rail are clamped by screws between the fixing parts.

8. The device per claim 7, wherein the fixing parts are identical.

9. The device per claim 6, wherein the fixing device is a one-piece design.

10. The device per claim 6, wherein the fixing device includes a frame-like fixing part fastened in a T-shaped groove of the rail.

11. The device per claim 1, wherein the bolt and the tension element are at least partly recessed into the fixing device in the direction of suspension.

12. The device per claim 11, wherein the bolt is completely recessed into the fixing device in the direction of suspension.

13. The device per claim 1, wherein the bolt and the tension element are at least partly recessed into the fixing device in the direction of suspension.

14. The device per claim 1, wherein the bolt is completely recessed into the fixing device in the direction of suspension.

15. The device per claim 1, wherein the fixing device has an intermediate space perpendicular to the direction of suspension and perpendicular to the bolt, said fixing device having a U-shaped form open at the top, wherein one of the tension element and the tension element and the bolt protrude into the intermediate space, the bolt being oriented with its lengthwise dimension parallel to the lengthwise direction. of the rail.

16. The device per claim 1, wherein the bolt is held free of torsion in bores in the fixing device, wherein ends of the bolt protrude beyond pivoting bearing.

17. The device per claim 1, wherein the fixing device has two fixing parts, wherein ends of the bolt and the rail are clamped by screws between the fixing parts.

18. The device per claim 17, wherein the fixing parts are identical.

19. The device per claim 1, wherein the fixing device is a one-piece design.

20. The device per claim 1, wherein the fixing device includes a frame-like fixing part fastened in a T-shaped groove of the rail.

21. A device for suspending a rail of one of an overhead conveyor and a hoisting machine from one of a traversing gear and a supporting structure, said device comprising:

a tension element, said tension element being secured by one end to the one of a traversing gear and a supporting structure, said tension element being further secured to a fixing device that is secured to the rail;

a bolt, the bolt passing through the tension element and being received by the fixing device, wherein the tension element is at least partly recessed in the fixing device in a direction of suspension;

a pivoting bearing comprising an outer race and an inner race, said inner race comprising a ball head, said ball head pivotably received in said outer race;

a bore defined through said ball head;

wherein the tension element is fastened to the bolt by the pivoting bearing being received in the tension element and the bolt passing through said bore in the ball head; and wherein the fixing device has an intermediate space perpendicular to the direction of suspension and perpendicular to the bolt, said intermediate space having a U-shaped form open at the top, wherein one of the tension e1ement, and the tension element and the bolt, protrude into the intermediate space, the bolt being oriented with its lengthwise dimension parallel to the lengthwise direction of the rail.

22. The device per claim 21, wherein the bolt is held free of torsion in bores in the fixing device, wherein ends of said bolt protrude beyond the pivoting bearing.

23. The device per claim 22, wherein the fixing device has two fixing parts, wherein said ends of the bolt and the rail are clamped by screws between the fixing parts.

24. The device per claim 23, wherein the fixing parts are identical.

25. The device per claim 22, wherein the fixing device is a one-piece design.

26. The device per claim 22, wherein the fixing device includes a frame-like fixing part fastened in a T-shaped groove of the rail.

* * * * *

UNITED STATES PATENT AND TRADEMARK OFFICE

CERTIFICATE OF CORRECTION

PATENT NO. : 7,503,263 B2
APPLICATION NO. : 11/537116
DATED : March 17, 2009
INVENTOR(S) : Reinhard Birkight et al.

It is certified that error appears in the above-identified patent and that said Letters Patent is hereby corrected as shown below:

Column 12:
Line 42, Claim 15, Delete "." after "direction".

Column 13:
Line 13, Claim 21, "element" should be --element--.

Signed and Sealed this

Fifth Day of May, 2009

JOHN DOLL
*Acting Director of the United States Patent and Trademark Office*